US010175593B2

(12) United States Patent
Vandewinckel et al.

(10) Patent No.: US 10,175,593 B2
(45) Date of Patent: Jan. 8, 2019

(54) COLD WAX DISPERSION PROCESS

(71) Applicant: XEROX CORPORATION, Norwalk, CT (US)

(72) Inventors: Judith M. Vandewinckel, Livonia, NY (US); Kevin F. Marcell, Webster, NY (US); Chieh-Min Cheng, Rochester, NY (US); Brian J. Marion, Ontario, NY (US); Scott M. Smith, Webster, NY (US)

(73) Assignee: XEROX CORPORATION, Norwalk, CT (US)

( * ) Notice: Subject to any disclaimer, the term of this patent is extended or adjusted under 35 U.S.C. 154(b) by 247 days.

(21) Appl. No.: 15/250,326

(22) Filed: Aug. 29, 2016

(65) Prior Publication Data

US 2018/0059559 A1 Mar. 1, 2018

(51) Int. Cl.

| | |
|---|---|
| ***B02C 23/12*** | (2006.01) |
| ***G03G 9/08*** | (2006.01) |
| ***G03G 9/087*** | (2006.01) |

(52) U.S. Cl.

CPC ..... *G03G 9/0804* (2013.01); *B02C 23/12* (2013.01); *G03G 9/0812* (2013.01); *G03G 9/0817* (2013.01); *G03G 9/0819* (2013.01); *G03G 9/0821* (2013.01); *G03G 9/08782* (2013.01)

(58) Field of Classification Search

CPC .. G03G 9/0804; G03G 9/0817; G03G 9/0819; G03G 9/0821; B02C 23/12

USPC ..... 428/402

See application file for complete search history.

(56) References Cited

U.S. PATENT DOCUMENTS

2014/0105942 A1* 4/2014 Pistorio ..... A61K 8/416 424/401

2015/0370184 A1* 12/2015 Araki ..... G03G 9/09335 430/105

FOREIGN PATENT DOCUMENTS

| | | | |
|---|---|---|---|
| EP | 2013276 | * | 1/2009 |
| JP | 2010-085674 A | | 4/2010 |
| JP | 2010085674 | * | 4/2010 |
| WO | 2007/124268 A3 | | 11/2007 |

OTHER PUBLICATIONS

European Patent Office: Extended European Search Report re: Xerox Patent Application No. 17188046.1 dated Dec. 5, 2017, six pages.

* cited by examiner

*Primary Examiner* — Leszek B Kiliman

(74) *Attorney, Agent, or Firm* — Pillsbury Winthrop Shaw Pittman LLP

(57) ABSTRACT

A method includes grinding a wax into wax particles having a size in a range from about 600 microns to about 800 microns forming a mixture of the wax particles with water and a surfactant; and homogenizing the mixture to form a wax dispersion, the homogenizing step is maintained below about 35° C. A wax dispersion includes a wax a surfactant; and water, particles of the wax dispersion are a uniform, irregular, non-platelet morphology. A wax dispersion made by a process includes grinding a wax into wax particles having a size in a range from about 600 microns to about 800 microns, forming a mixture of the wax particles with water and a surfactant, and homogenizing the mixture to form a wax dispersion, the homogenizing step is maintained below about 35° C. and the wax has a uniform, irregular, non-platelet morphology imparted by combination of the grinding and homogenizing steps.

20 Claims, 3 Drawing Sheets

COLD WAX DISPERSION PROCESS

BACKGROUND

The present disclosure relates to wax dispersions and processes for their preparation. In particular, the present disclosure relates to wax dispersion preparations suitable for downstream use in the manufacture of toner particles.

There is a continuing interest in developing methods for preparing wax dispersions to reduce toner costs. In particular, there is an interest in processes that consume less energy and result in less waste which are typical of conventional high pressure, high temperature wax dispersion processes.

SUMMARY

In some aspects, embodiments herein relate to methods comprising grinding a wax into wax particles having a size in a range from about 600 microns to about 800 microns forming a mixture of the wax particles with water and a surfactant and homogenizing the mixture to form a wax dispersion wherein the homogenizing step is maintained below about 35° C.

In some aspects, embodiments herein relate to wax dispersions comprising a wax a surfactant; and water wherein particles of the wax dispersion are a uniform, irregular, non-platelet morphology.

In some aspects, embodiments herein relate to wax dispersions made by the process comprising grinding a wax into wax particles having a size in a range from about 600 microns to about 800 microns forming a mixture of the wax particles with water and a surfactant and homogenizing the mixture to form a wax dispersion, wherein the homogenizing step is maintained below about 35° C., and wherein the wax has a uniform, irregular, non-platelet morphology imparted by combination of the grinding and homogenizing steps.

BRIEF DESCRIPTION OF DRAWINGS

Various embodiments of the present disclosure will be described herein below with reference to the figures wherein.

DETAILED DESCRIPTION

Figure 3A:
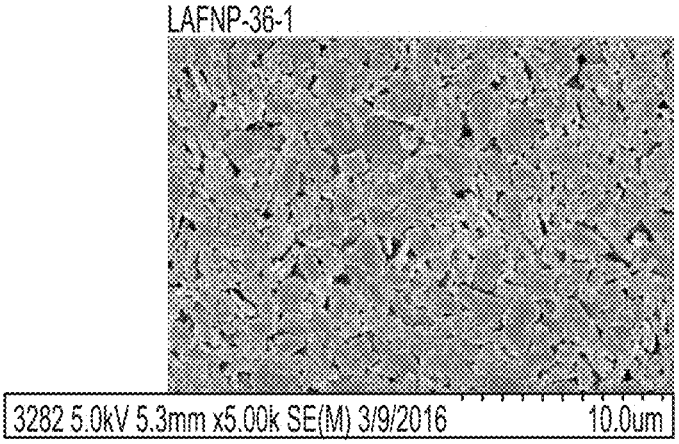
FIG. 3A shows a scanning electron microscope (SEM) image of a wax dispersion in accordance with embodiments herein.
Figure 3B:
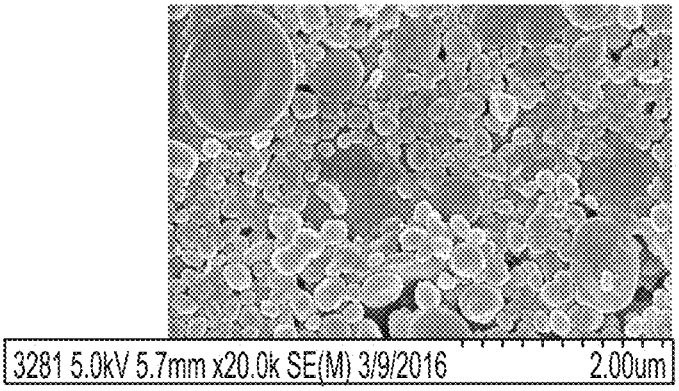
FIG. 3B shows a SEM image of a wax dispersion prepared in a manner typical of the prior art.

Embodiments herein provide for cold processes for preparing wax dispersions that use less energy, and reduce waste relative to existing processes for preparing wax dispersions resulting in lower associated costs. For example, less energy is consumed because the process requires no heating and subsequent quenching. In addition to the disclosed processes, embodiments herein provide wax dispersions with particle morphology that makes them distinct from wax dispersions prepared by conventional methods. FIGS. 3A and 3B show a comparison of SEM images of a typical wax dispersion morphology (3B) to the unique wax morphology (3A) as described in the present embodiments.

Processes disclosed herein have been used to prepare wax dispersions of the exemplary waxes shown below in Table 1. Processes disclosed herein have also been successfully used with Sasol wax C80 Fisher-Tropsch wax (Paraffin, Synthetic), and FN90 paraffin ($T_m$ 92° C.).

TABLE 1

| Dispersion | Type | Tm (° C.) | Source |
|---|---|---|---|
| N-539 | Paraffin | 75 | Cytech Inc |
| Q436 | Polymethylene | 90-92 | Cytech Inc |
| D1509 | Polymethylene | 91 | IGI |
| D1508 | Polyethylene | 91 | Baker Hughes |
| D1479 | Polyethylene | 100 | Baker Hughes |

In embodiments, two main steps are provided for a "cold" processing. First, the wax is ground in a blender with a blade configuration that moves the pellets in an upward motion and utilizes the blender internal body as a means to grind the pellets. A standard Henschel blender can be used with a new blade configuration disclosed herein that is believed to propel the wax pellets in an upward motion and uses the pellets, as well as the walls of the blender, to grind the pellets. Blender toolings typically have smooth angled edges on the blade sides. The use of different configurations such as incorporating spacers for multiple blades is also known. Such features are typically added along a shaft. This type of tooling is used for aerating and blending but are not functionally designed to grind materials. Although standard blade tooling can be used in a blender to grind materials, using normal blade configurations from the supplier can result in longer cycle times and uneven grind particle size distributions which can in turn influence the yield prior to making an emulsion.

In particular embodiments, a typical Henschel blender volume fill of about 45% may be used. A Henschel blender may have volumes such as about 100 liters, or about 1,000 liters, or up to about 1,200 liters. Volume loading may range from about 30% to about 55% to obtain effective grinding while still attaining a grind bed for the particles to turnover while grinding. Grinding process was most effective at 45% volume loading. The wax may be processed to about 600 micron to about 800 micron particles. Jacket cooling may be used help to maintain a cool temperature during grinding. The second step uses a standard rotor/stator homogenization with cooling to keep the batch temperature below about 35° C. A surfactant is heated and dissolved in deionized water followed by mixing the ground wax materials to make a pre-emulsion. Once the materials are mixed for about 30 minutes, the mixing can be reduced to de-aerate until no foam is seen on the liquid surface. The pre-emulsion can then be homogenized to meet a target particle size and then filtered through a sieve or the like to provide a dispersion 50 micron wax particles.

Figure 3C:
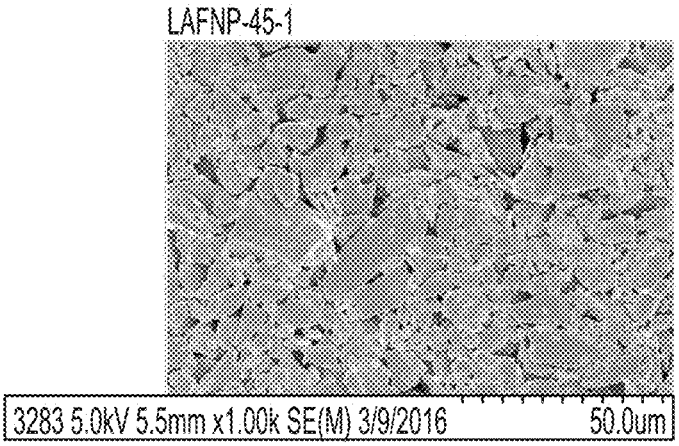
FIG. 3C shows a second SEM image of wax dispersion prepared in accordance with embodiments herein.

Although cold wax dispersion processes are known in other industries, typically very different waxes are employed and substantially larger particle sizes are prepared. Existing processes were deemed inadequate for the waxes and particles sizes needed for the target downstream application in toner particles. Embodiments herein beneficially provide cold wax processes for making wax dispersions with nano-size wax particles, which has not been accessible via conventional cold processing. Moreover, the resulting wax dispersion is perceivably different compared to typical cold processing as indicated by scanning electron microscopy (SEM). Typically, wax particles are platelets due to how they are processed as indicated in FIG. 3C. In sharp contrast, the wax particles prepared in accordance with embodiments herein appear translucent with a non-platelet round morphology as indicated in FIG. 3A. Wax dispersions were processed at 36% and 45% total solids, the resulting SEM images indicate the morphology of the wax processed.

In embodiments, there are provided methods comprising grinding a wax into wax particles having a size in a range from about 600 microns to about 800 microns, forming a mixture of the wax particles with water and a surfactant, and homogenizing the mixture to form a wax dispersion, wherein the homogenizing step is maintained below about 35° C.

In embodiments, the methods disclosed herein are "cold processes." As used, herein this term is used to indicate that there is no heating employed during any step of the wax dispersion process. Indeed, jacket cooling may be desirable during the initial grinding and/or during homogenization. Cold processes may be those maintained at a temperature not exceeding about 35° C. throughout the wax dispersion process, not just the homogenization step as described herein.

In embodiments, methods further comprise passing the wax particles through a sieve to separate out particles larger than about 800 microns. In embodiments, methods further comprise returning particles larger than about 800 microns that did not pass through the sieve back to a further grinding step. In embodiments, after forming the wax dispersion, methods may further comprise filtering the wax dispersion to a particle size of about 50 microns.

Figure 1:
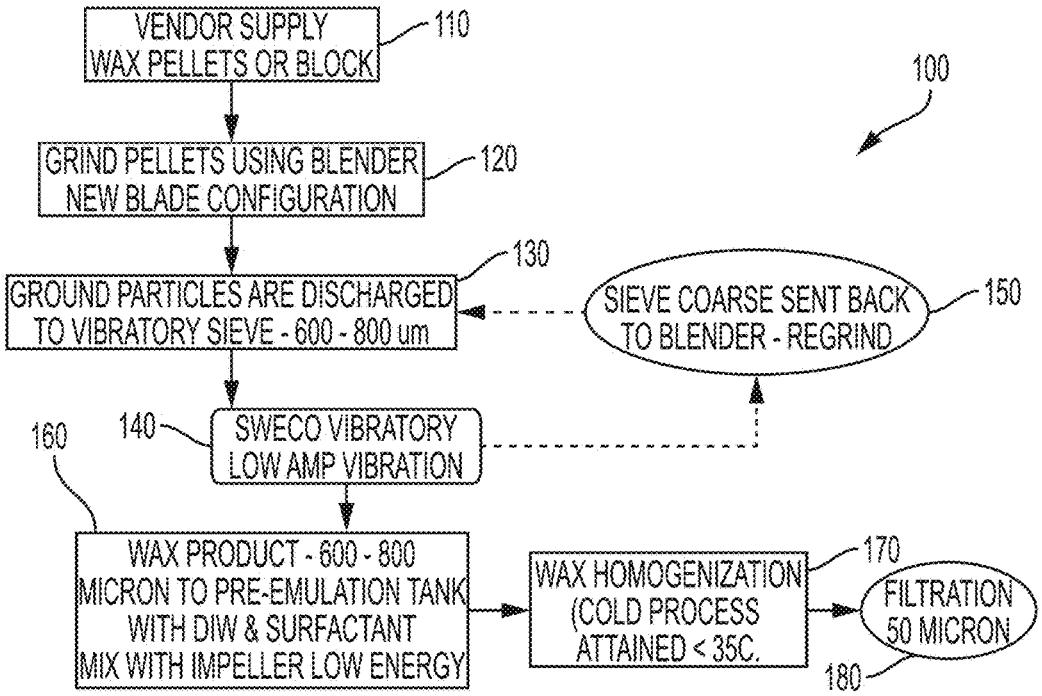
FIG. 1 shows an exemplary detailed flow scheme of a wax dispersion process in accordance with embodiments herein.

In embodiments, the grinding step may be performed with a blender. The blender may be equipped with a blade having a configuration that propels the wax in the grinding step upward in the blender. An exemplary configuration for such a blade is shown in FIG. 1. In performing the grinding step, it has been found beneficial that the blender have a fill volume of about 45%. The volume can be more or less, but with a standard Henschel blending system about 45% fill provides excellent grinding properties. Volume loadings may range from about 30% to about 55% to provide effective grinding while still attaining a grind bed for the particles to turnover while grinding.

In embodiments, the wax has a melting temperature ($T_m$) in a range from about 70° C. to about 100° C. In particular embodiments, the wax may be a paraffin wax. In other embodiments, the wax may be a polyethylene wax. Other suitable waxes for the dispersions disclosed herein include, but are not limited to, alkylene waxes such as alkylene wax having about 1 to about 25 carbon atoms, polyethylene, polypropylene or mixtures thereof. In embodiments, the waxes may be Fischer-Tropsch waxes, paraffin waxes, or combinations thereof. The waxes may be present, for example, in an amount of about 10% to about 50% by weight, with a process target total solids loading of about 45% within the emulsion or final wax dispersion based upon the total weight of the dispersion. Examples of waxes include polypropylenes and polyethylenes commercially available from Allied Chemical, Baker Hughes, IGI, Cytech Inc. and Petrolite Corporation. Other materials that may be useful include EPOLENE N-15™ commercially available from Eastman Chemical Products, Inc., VISCOL 550-P™, a low weight average molecular weight polypropylene available from Sanyo Kasei K.K., and similar materials. The commercially available polyethylenes may possess a molecular weight ($M_w$) of about 890 daltons 10,500 daltons, and the commercially available polypropylenes may possess a molecular weight of about 4,000 daltons to about 12,000 daltons.

Table 2 below shows actual Mw-Molecular Weight values tested on a High Temp GC HT-GC.

TABLE 2

| Type | Type | Mw lower range | Mw upper range |
|---|---|---|---|
| N-539 | Paraffin | 536 | 1156 |
| Q436, D1509 | Polymethylene | 635 | 717 |
| D1508, D1479 | Polyethylene | 894 | 1045 |

Other waxes may be plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax such as waxes derived from distillation of crude oil, silicone waxes, mercapto waxes, polyester waxes, urethane waxes; modified polyolefin waxes (such as a carboxylic acid-terminated polyethylene wax or a carboxylic acid-terminated polypropylene wax); Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethylene glycol monostearate, dipropylene glycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate.

Examples of functionalized waxes include amines, amides, for example Aqua SUPERSLIP 6550™, SUPERSLIP 6530™ available from Micro Powder Inc., fluorinated waxes, for example POLYFLUO 190™, POLYFLUO 200™, POLYFLUO 523XF™, AQUA POLYFLUO 41™, AQUA POLYSILK 19™, POLYSILK 14™ available from Micro Powder Inc., mixed fluorinated, amide waxes, for example Microspersion 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, chlorinated polypropylenes and polyethylenes available from Allied Chemical and Petrolite Corporation and SC Johnson Wax, and Q436B available from Cytech Inc.

Embodiments herein provide wax dispersions comprising a wax, a surfactant; and water; wherein particles of the wax dispersion are non-platelet in morphology. The morphology is more irregular and more uniform compared to a platelet type wax. In embodiments, the wax may be selected to have a melting temperature ($T_m$) in a range from about 70° C. to about 100° C. Such a range is not to be construed as limiting and the selection of this range is merely by reason of having a particular downstream application in mind in its selection, namely toner preparation. Thus, in such embodiments, the wax may appropriate be a paraffin wax or a polyethylene wax, or combinations thereof.

In embodiments, the surfactant comprises one or more selected from the group consisting of an anionic surfactant, a cationic surfactant, a zwitterionic surfactant, and combinations thereof. The processes for wax dispersion may include one, two, or more surfactants.

Anionic surfactants and cationic surfactants are encompassed by the term "ionic surfactants." In embodiments, the surfactant may be added as a solid or as a solution with a surfactant to wax ratio in parts per million of about 2.5 parts per hundred (pph) to about 9.0 pph. The solids concentration within the wax emulsion may be from about 17% to about 45%, with surfactant solids present in a range from about 60% to about 62% by weight as received from supplier, in embodiments, or from about 17% to about 45% by weight. In embodiments, the surfactant in such a case may be present in an amount of from about 0.2% to about 7% by weight of the wax dispersion, in embodiments, or from about 0.1% to about 45% by weight of the wax dispersion solids, in other embodiments, or from about 1% to about 45% by weight of the wax dispersion. That is, the surfactant may be commercially provided in a paste form having a solid content of about 60% solids, 40% water. The surfactant solids can change plus or minus about 3%, and thus one should test the moisture content and adjust the recipe to target a loading of about pph 2.5 pph to about 9.0 pph as demonstrated for the surfactant to wax ratio. The processing solids, i.e., the wax emulsion (which includes the surfactant and wax solids) can be processed at about 17% to about 45% of the dispersion.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecylbenzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, C12, C15, C17 trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Examples of nonionic surfactants that may be utilized for the processes illustrated herein include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly (ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants may include a block copolymer of polyethylene oxide and polypropylene oxide, including those commercially available as SYNPERONIC® PE/F, in embodiments SYNPERONIC® PE/F 108. Combinations of these surfactants and any of the foregoing surfactants may be utilized in embodiments.

In embodiments, the surfactant is present in a range from about 0.2 percent to about 7.0 percent by weight of the dispersion. In embodiments, the wax is present in a range from about 36 percent to about 45 percent by weight of the dispersion. In embodiments, a weight ratio of the surfactant to the wax is in a range from about 2.5pph, 36% wax solids to about 9.0 pph, 45% wax solids, or about 9.0 pph, about 36% wax solids to about 2.5 pph, about 45% wax solids.

In embodiments, there are provided wax dispersions made by the process comprising grinding a wax into wax particles having a size in a range from about 600microns to about 800 microns, forming a mixture of the wax particles with water and a surfactant, and homogenizing the mixture to form a wax dispersion, wherein the homogenizing step is maintained below about 35° C. and wherein the wax has a non-platelet morphology imparted by combination of the grinding and homogenizing steps. In particular embodiments, the non-platelet morphology is substantially spherical. In embodiments, the wax has a melting temperature (Tm) in a range from about 70° C. to about 100° C. In embodiments, a sieving step is performed prior to forming the mixture.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Example 1

This example describes the preparation of a wax dispersion in accordance with embodiments herein.

Figure 2:
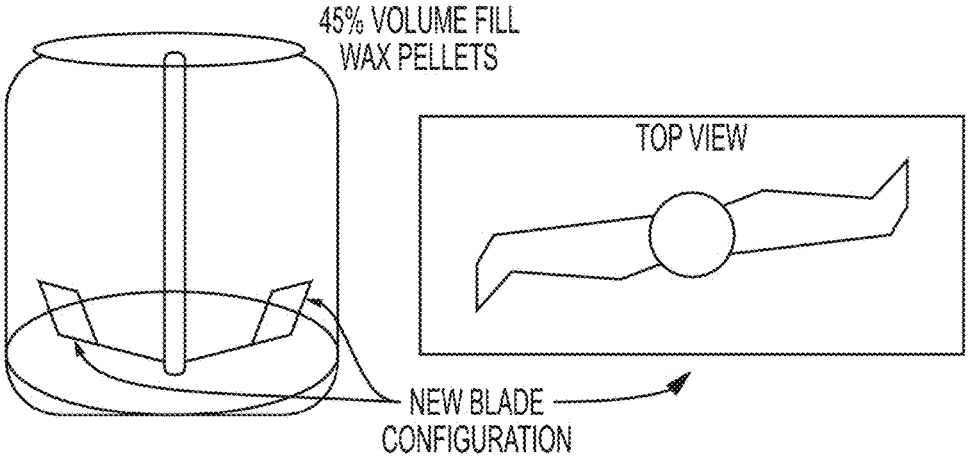
FIG. 2 shows the configuration of a blender blade useful in a grinding step, in accordance with embodiments herein.

General procedure: A general scheme is shown in FIG. 1 for an exemplary cold processing method 100 in accordance with embodiments herein. A wax is provided 110, as received in pellet or block form from a commercial source, and is ground 120 in a blender with a blade configuration (See FIG. 2) that moves the pellets in an upward motion and utilizes the blender internal body as a means to grind the pellets. A standard Henschel blender can be used with a new blade configuration that propels the wax pellets in an upward motion and uses the pellets as well as the walls of the blender to grind the pellets. A volume fill of about 45% was demonstrated to be effective in grinding down particles of wax to about 600 to about 800 microns. At this point, the particles can be optionally discharged 130 into a vibratory sieve and subjected to low amp vibration 140 and larger particles may be returned 150 back to the blender. Jacket cooling can be used to maintain a cool temperature during grinding. The 600 to 800 micron particles can be mixed 160 with deionized water (DIW) and surfactant and then subjected to homogenization 170 standard rotor/stator with cooling to keep the batch temperature below about 35° C. In a particular application carried out in the laboratory, Tayca was heated and dissolved in DIW followed by mixing the wax ground materials with the surfactant to make a pre-emulsion. Once the materials were mixed for half an hour the mixing was reduced to de-aerate until no foam is seen on the liquid surface. The pre-emulsion was then homogenized 170 to meet a nano particle size and filtered 180 to 50 microns.

The above procedure was carried out to make a wax dispersion using rotor/stator homogenization process over five hours while maintaining a batch temperature less than about 35° C. The process resulted in particles with the desired $D_{50}$ target of 494 nanometers, with about 53% of the particles at about 320 nm. Trials were done using 36% solids and 45% solids with surfactant levels of 9 pph and 2.5 pph respectively. The starting coarse ground wax particles were ground to 850 microns and 600 microns. Results are summarized below in Table 3.

TABLE 3

| Recipe | Example 1 Demonstrated | Example 2 Demonstrate |
|---|---|---|
| Total solids (%) | 36 | 45 |
| Surfactant to wax ratio (pph) | 9 | 2.5 |
| Surfactant paste as received (%) | 60-62 | 60-62 |
| Surfactant solids added | 40 | 40 |
| Water | 62 | 54.27 |

Figure 4:
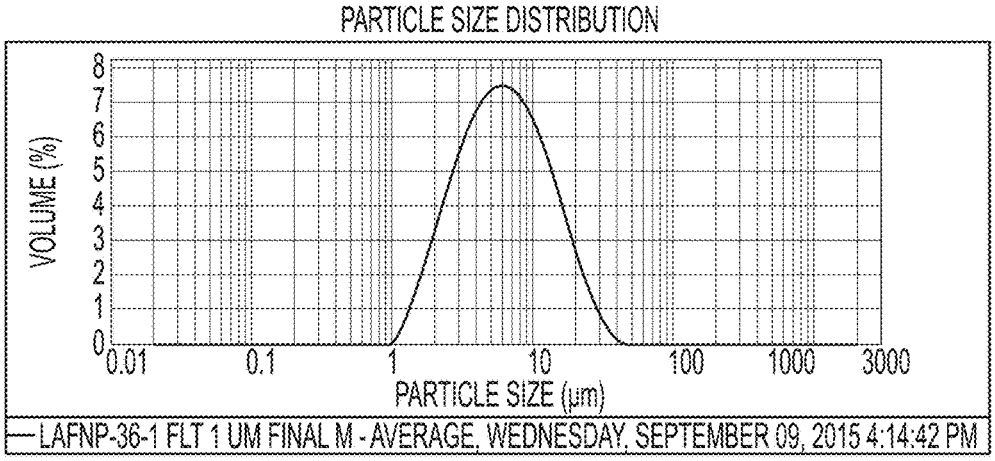
FIG. 4 shows a plot of particle size distribution for a wax emulsion/dispersion at a 36% solids loading and a recipe of 9 pph surfactant to wax ratio in the wax dispersion.

FIG. 4 shows a plot from a Mastersizer analysis of particle size for the wax emulsion/dispersion at a 36% solids loading and a recipe of 9 pph surfactant to wax ratio in the wax dispersion. This wax was made using the the cold process disclosed herein. The wax was filtered and the resulting $D_{50}$ was about 6 microns.

What is claimed is:

1. A method comprising:

grinding a wax into wax particles having a size in a range from about 600 microns to about 800 microns;

forming a mixture of the wax particles with water and a surfactant; and homogenizing the mixture to form a wax dispersion;

wherein the homogenizing step is maintained below about 35° C.

2. The method of claim 1, further comprising passing the wax particles through a sieve to separate out particles larger than about 800 microns.

3. The method of claim 2, further comprising returning particles larger than about 800 microns that did not pass through the sieve back to a further grinding step.

4. The method of claim 1, further comprising filtering the wax dispersion to a particle size of about 50 microns.

5. The method of claim 1, wherein the grinding step is performed with a blender.

6. The method of claim 5, wherein the blender is equipped with a blade having a configuration that propels the wax in the grinding step upward in the blender.

7. The method of claim 5, wherein the blender has a fill volume of about 45%.

8. The method of claim 1, wherein the wax has a melting temperature ($T_m$) in a range from about 70° C. to about 100° C.

9. The method of claim 1, wherein the wax is a paraffin wax.

10. The method of claim 1, wherein the wax is a polyethylene wax.

11. A wax dispersion comprising:

a wax;

a surfactant; and water;

wherein particles of the wax dispersion are a uniform, irregular, non-platelet morphology.

12. The wax of claim 11, wherein the wax has a melting temperature ($T_m$) in a range from about 70° C. to about 100° C.

13. The wax of claim 11, wherein the wax is a paraffin wax.

14. The wax of claim 11, wherein the wax is a polyethylene wax.

15. The wax of claim 11, wherein the surfactant comprises one or more selected from the group consisting of an anionic surfactant, a cationic surfactant, a zwitterionic surfactant, and combinations thereof.

16. The wax of claim 11, wherein the surfactant is present in a range from about 0.2 percent to about 7 percent by weight of the dispersion.

17. The wax of claim 11, wherein the wax is present in a range from about 35 percent to about 45 percent by weight of the dispersion.

18. A wax dispersion made by the process comprising:

grinding a wax into wax particles having a size in a range from about 600 microns to about 800 microns;

forming a mixture of the wax particles with water and a surfactant; and homogenizing the mixture to form a wax dispersion;

wherein the homogenizing step is maintained below about 35° C. and wherein the wax has a non-platelet morphology imparted by combination of the grinding and homogenizing steps.

19. The wax of claim 18, wherein the wax has a melting temperature ($T_m$) in a range from about 70° C. to about 10° C.

20. The wax of claim 18, wherein a sieving step is performed prior to forming the mixture.

* * * * *